US009970326B2

(12) United States Patent
Roberts et al.

(10) Patent No.: US 9,970,326 B2
(45) Date of Patent: May 15, 2018

(54) GAS TURBINE IN SITU INFLATABLE BLADDERS FOR ON-WING REPAIR

(71) Applicant: General Electric Company, Schenectady, NY (US)

(72) Inventors: Herbert Chidsey Roberts, Middletown, OH (US); David Scott Diwinsky, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days. days.

(21) Appl. No.: 15/057,236

(22) Filed: Mar. 1, 2016

(65) Prior Publication Data

US 2017/0254221 A1 Sep. 7, 2017

(51) Int. Cl.

| | |
|---|---|
| ***F01D 25/28*** | (2006.01) |
| ***F01D 5/00*** | (2006.01) |
| *F01D 25/00* | (2006.01) |

(52) U.S. Cl.

CPC ..... *F01D 25/285* (2013.01); *F01D 5/005* (2013.01); *F01D 25/002* (2013.01); *F05D 2220/32* (2013.01); *F05D 2230/60* (2013.01); *F05D 2230/80* (2013.01)

(58) Field of Classification Search

CPC ..... F01D 25/285; F05D 2220/32; F05D 2230/80; F05D 2230/60; Y10T 29/53965; Y10T 29/53974; Y10T 29/53996

See application file for complete search history.

(56) References Cited

U.S. PATENT DOCUMENTS

| | | | | |
|---|---|---|---|---|
| 2,366,164 | A | 1/1945 | Weick et al. | |
| 6,206,067 | B1 | 3/2001 | Kociemba et al. | |
| 6,270,603 | B1 | 8/2001 | Westerman et al. | |
| 6,542,230 | B1 | 4/2003 | Luke | |
| 6,640,437 | B2 * | 11/2003 | McFarland | B25B 27/00 29/23.51 |
| 6,671,938 | B2 | 1/2004 | McFarland | |
| 7,032,279 | B2 | 4/2006 | McCarvill et al. | |
| 7,278,208 | B2 | 10/2007 | LeSaint et al. | |
| 7,810,696 | B2 | 10/2010 | Nunnery | |
| 8,801,502 | B2 | 8/2014 | Ng et al. | |
| 8,927,897 | B2 | 1/2015 | Xu et al. | |
| 8,991,047 | B2 | 3/2015 | Anasis et al. | |
| 2006/0042083 | A1 | 3/2006 | Baker et al. | |
| 2006/0157906 | A1 | 7/2006 | Clark | |

(Continued)

OTHER PUBLICATIONS

European Search Report and Written Opinion issued in connection with corresponding EP Application No. 17157963.4 dated Jul. 28, 2017.

*Primary Examiner* — Richard Chang
(74) *Attorney, Agent, or Firm* — General Electric Company; Pamela A. Kachur

(57) ABSTRACT

A method for forming an in situ temporary barrier within a gas turbine engine is provided. The method can include installing a bladder within the gas turbine engine, wherein the bladder defines a bladder body, and inflating the bladder with an inflating fluid such that the bladder body forms a circumferential seal within the gas turbine engine. The bladder body can be positioned between a row of stator vanes and an annular array of rotating blades to form a circumferential seal therebetween. A second bladder may be positioned circumferentially within the gas turbine engine.

20 Claims, 4 Drawing Sheets

(56) References Cited

U.S. PATENT DOCUMENTS

| | | | |
|---|---|---|---|
| 2015/0001086 | A1 | 1/2015 | Dimascio et al. |
| 2015/0034266 | A1 | 2/2015 | Bruck et al. |
| 2015/0174838 | A1 | 6/2015 | Kittleson et al. |
| 2016/0032743 | A1 | 2/2016 | Duchaine |

* cited by examiner

GAS TURBINE IN SITU INFLATABLE BLADDERS FOR ON-WING REPAIR

FIELD OF THE INVENTION

The present subject matter relates generally to gas turbine engines and, more particularly, to a system and method for performing an in situ repair of an internal component of a gas turbine engine.

BACKGROUND OF THE INVENTION

A gas turbine engine typically includes a turbomachinery core having a high pressure compressor, combustor, and high pressure turbine in serial flow relationship. The core is operable in a known manner to generate a primary gas flow. The high pressure compressor includes annular arrays ("rows") of stationary vanes that direct air entering the engine into downstream, rotating blades of the compressor. Collectively one row of compressor vanes and one row of compressor blades make up a "stage" of the compressor. Similarly, the high pressure turbine includes annular rows of stationary nozzle vanes that direct the gases exiting the combustor into downstream, rotating blades of the turbine. Collectively one row of nozzle vanes and one row of turbine blades make up a "stage" of the turbine. Typically, both the compressor and turbine include a plurality of successive stages.

Gas turbine engines, particularly aircraft engines, require a high degree of periodic maintenance. For example, periodic maintenance is often scheduled to allow internal components of the engine to be inspected for defects and subsequently repaired. Unfortunately, many conventional repair methods used for aircraft engines require that the engine be removed from the body of the aircraft and subsequently partially or fully disassembled. As such, these repair methods result in a significant increase in both the time and the costs associated with repairing internal engine components.

However, performing in situ service or repair procedures on gas turbines is complicated because some of the repair or service procedures can unintentionally harm portions of the gas turbine due to fluid or gas based over spray, weld splatter, or waste partials during material removal operations. Accordingly, a system and method for performing an in situ repair of an internal component of a gas turbine engine would be welcomed within the technology.

BRIEF DESCRIPTION OF THE INVENTION

Aspects and advantages of the invention will be set forth in part in the following description, or may be obvious from the description, or may be learned through practice of the invention.

A method is generally provided for forming an in situ temporary barrier within a gas turbine engine. In one embodiment, the method includes installing a bladder within the gas turbine engine, wherein the bladder defines a bladder body, and inflating the bladder with an inflating fluid such that the bladder body forms a circumferential seal within the gas turbine engine.

For example, the bladder body can be positioned between a row of stator vanes and an annular array of rotating blades to form a circumferential seal therebetween.

In certain embodiments, a second bladder may be positioned circumferentially within the gas turbine engine.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended Figs., in which.

Figure 1:
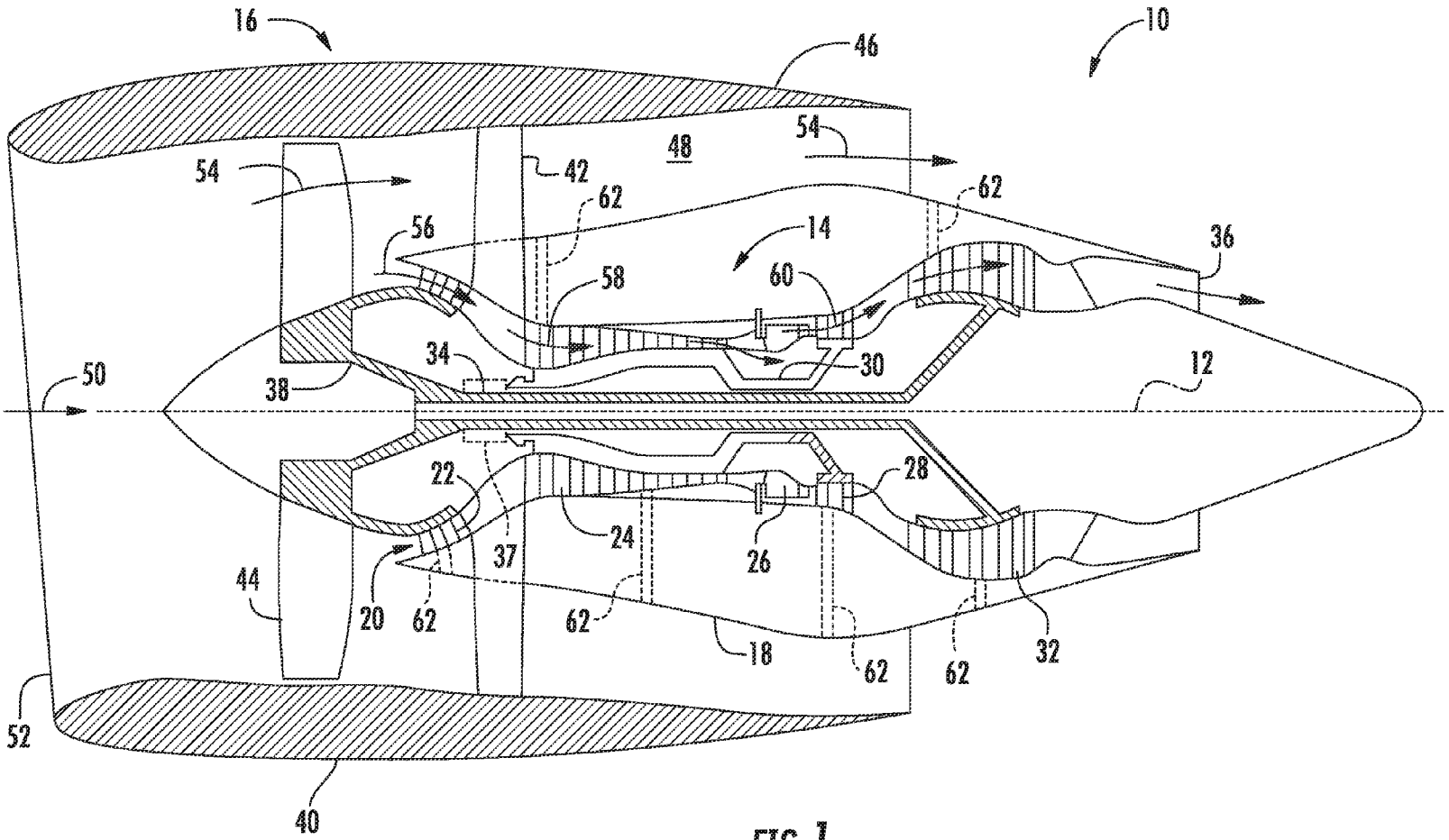
FIG. 1 illustrates a cross-sectional view of one embodiment of a gas turbine engine that may be utilized within an aircraft in accordance with aspects of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

In general, a system and method is provided for performing an in situ repair of an internal component of a gas turbine engine. In one embodiment, an inflatable bladder can be utilized to form a circumferential seal within the gas turbine.

Once inflated, the inflatable bladder can form a temporary barrier inside the gas turbine. Having the ability to set up a temporary barrier inside the gas turbine can help reduce the risk of harming unintended regions of the gas turbine during in situ repair. In particular embodiments, for example, two or more barriers can be used to establish an isolated area within the engine. For example, the isolated area can be a washing zone, deposition zone, or other work zone inside the gas turbine. In one embodiment, the washing zone can exposed to rinsing and washing fluids, solvents, and soaps, to locally fill the gas turbine to wash a large region of the gas turbine, while limiting the rinsing and washing from reaching other regions of the gas turbine.

It should be appreciated that the disclosed system and method may generally be used to perform in situ repairs of internal components located within any suitable type of gas turbine engine, including aircraft-based turbine engines and land-based turbine engines, regardless of the engine's current assembly state (e.g., fully or partially assembled). Additionally, with reference to aircraft engines, it should be appreciated that the present subject matter may be implemented on-wing or off-wing.

Referring now to the drawings, FIG. 1 illustrates a cross-sectional view of one embodiment of a gas turbine engine 10 that may be utilized within an aircraft in accordance with aspects of the present subject matter, with the engine 10 being shown having a longitudinal or axial centerline axis 12 extending therethrough for reference purposes. In general, the engine 10 may include a core gas turbine engine (indicated generally by reference character 14) and a fan section 16 positioned upstream thereof. The core engine 14 may generally include a substantially tubular outer casing 18 that defines an annular inlet 20. In addition, the outer casing 18 may further enclose and support a booster compressor 22 for increasing the pressure of the air that enters the core engine 14 to a first pressure level. A high pressure, multi-stage, axial-flow compressor 24 may then receive the pressurized air from the booster compressor 22 and further increase the pressure of such air. The pressurized air exiting the high-pressure compressor 24 may then flow to a combustor 26 within which fuel is injected into the flow of pressurized air, with the resulting mixture being combusted within the combustor 26. The high energy combustion products are directed from the combustor 26 along the hot gas path of the engine 10 to a first (high pressure) turbine 28 for driving the high pressure compressor 24 via a first (high pressure) drive shaft 30, and then to a second (low pressure) turbine 32 for driving the booster compressor 22 and fan section 16 via a second (low pressure) drive shaft 34 that is generally coaxial with first drive shaft 30. After driving each of turbines 28 and 32, the combustion products may be expelled from the core engine 14 via an exhaust nozzle 36 to provide propulsive jet thrust.

Additionally, as shown in FIG. 1, the fan section 16 of the engine 10 may generally include a rotatable, axial-flow fan rotor assembly 38 that is configured to be surrounded by an annular fan casing 40. It should be appreciated by those of ordinary skill in the art that the fan casing 40 may be configured to be supported relative to the core engine 14 by a plurality of substantially radially-extending, circumferentially-spaced outlet guide vanes 42. As such, the fan casing 40 may enclose the fan rotor assembly 38 and its corresponding fan rotor blades 44. Moreover, a downstream section 46 of the fan casing 40 may extend over an outer portion of the core engine 14 so as to define a secondary, or by-pass, airflow conduit 48 that provides additional propulsive jet thrust.

It should be appreciated that, in several embodiments, the second (low pressure) drive shaft 34 may be directly coupled to the fan rotor assembly 38 to provide a direct-drive configuration. Alternatively, the second drive shaft 34 may be coupled to the fan rotor assembly 38 via a speed reduction device 37 (e.g., a reduction gear or gearbox) to provide an indirect-drive or geared drive configuration. Such a speed reduction device(s) may also be provided between any other suitable shafts and/or spools within the engine 10 as desired or required.

During operation of the engine 10, it should be appreciated that an initial air flow (indicated by arrow 50) may enter the engine 10 through an associated inlet 52 of the fan casing 40. The air flow 50 then passes through the fan blades 44 and splits into a first compressed air flow (indicated by arrow 54) that moves through conduit 48 and a second compressed air flow (indicated by arrow 56) which enters the booster compressor 22. The pressure of the second compressed air flow 56 is then increased and enters the high pressure compressor 24 (as indicated by arrow 58). After mixing with fuel and being combusted within the combustor 26, the combustion products 60 exit the combustor 26 and flow through the first turbine 28. Thereafter, the combustion products 60 flow through the second turbine 32 and exit the exhaust nozzle 36 to provide thrust for the engine 10.

The gas turbine engine 10 may also include a plurality of access ports defined through its casings and/or frames for providing access to the interior of the core engine 14. For instance, as shown in FIG. 1, the engine 10 may include a plurality of access ports 62 (only six of which are shown) defined through the outer casing 18 for providing internal access to one or both of the compressors 22, 24 and/or for providing internal access to one or both of the turbines 28, 32. In several embodiments, the access ports 62 may be spaced apart axially along the core engine 14. For instance, the access ports 62 may be spaced apart axially along each compressor 22, 24 and/or each turbine 28, 32 such that at least one access port 62 is located at each compressor stage and/or each turbine stage for providing access to the internal components located at such stage(s). In addition, the access ports 62 may also be spaced apart circumferentially around the core engine 14. For instance, a plurality of access ports 62 may be spaced apart circumferentially around each compressor stage and/or turbine stage.

It should be appreciated that, although the access ports 62 are generally described herein with reference to providing internal access to one or both of the compressors 22, 24 and/or for providing internal access to one or both of the turbines 28, 32, the gas turbine engine 10 may include access ports 62 providing access to any suitable internal location of the engine 10, such as by including access ports 62 that provide access within the combustor 26 and/or any other suitable component of the engine 10.

Figure 2:
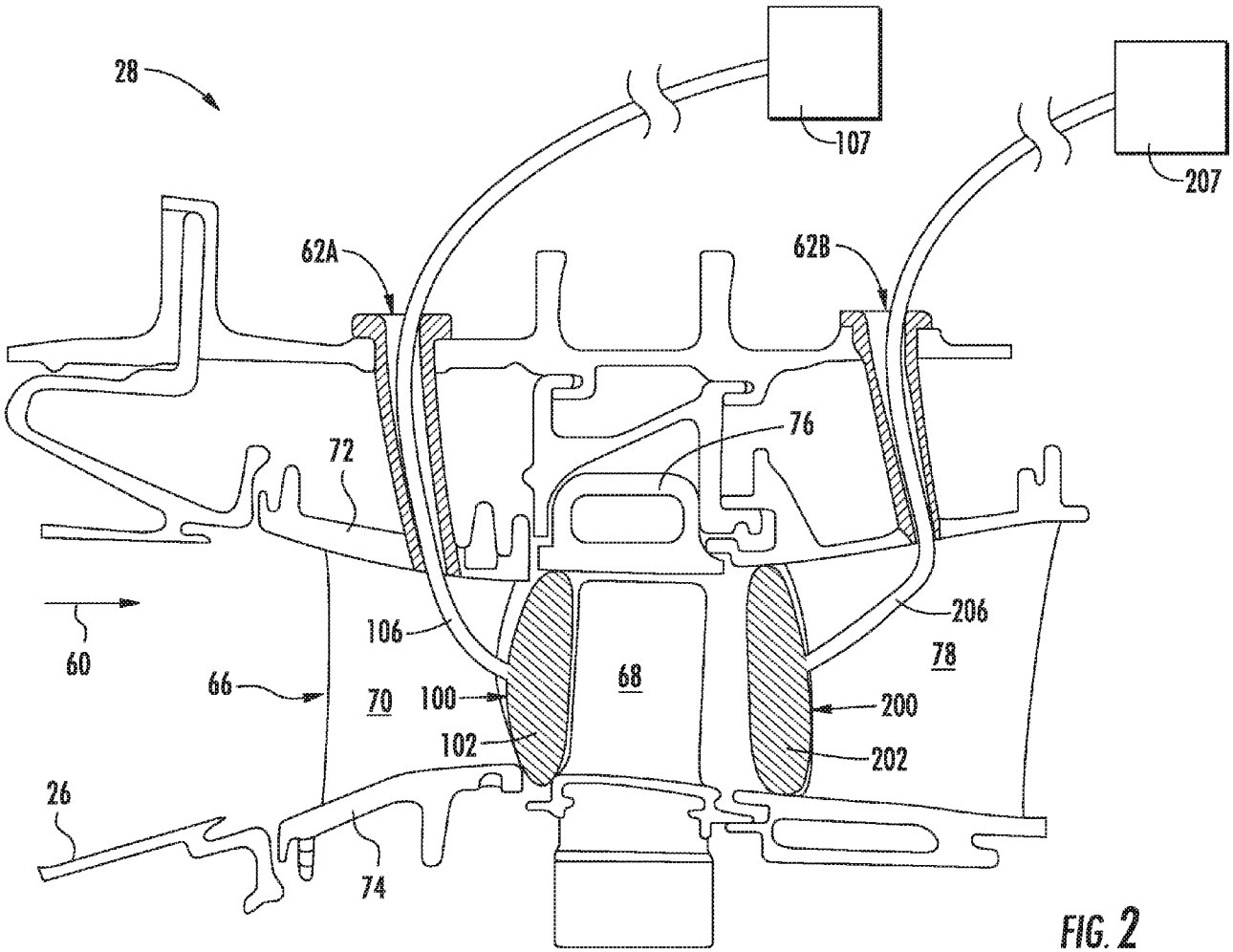
FIG. 2 illustrates a partial, cross-sectional view of one embodiment of a turbine suitable for use within the gas turbine engine shown in FIG. 1, particularly illustrating access ports defined in the engine for providing internal access to the turbine.

Referring now to FIG. 2, a partial, cross-sectional view of the first (or high pressure) turbine 28 described above with reference to FIG. 1 is illustrated in accordance with embodiments of the present subject matter. As shown, the first turbine 28 may include a first stage turbine nozzle 66 and an annular array of rotating turbine blades 68 (one of which is shown) located immediately downstream of the nozzle 66. The nozzle 66 may generally be defined by an annular flow channel that includes a plurality of radially-extending, circularly-spaced nozzle vanes 70 (one of which is shown). The vanes 70 may be supported between a number of arcuate outer bands 72 and arcuate inner bands 74. Additionally, the circumferentially spaced turbine blades 68 may generally be configured to extend radially outwardly from a rotor disk (not shown) that rotates about the centerline axis 12 (FIG. 1) of the engine 10. Moreover, a turbine shroud 76 may be positioned immediately adjacent to the radially outer tips of the turbine blades 68 so as to define the outer radial flowpath boundary for the combustion products 60 flowing through the turbine 28 along the hot gas path of the engine 10.

As indicated above, the turbine 28 may generally include any number of turbine stages, with each stage including an annular array of nozzle vanes and follow-up turbine blades 68. For example, as shown in FIG. 2, an annular array of nozzle vanes 78 of a second stage of the turbine 28 may be located immediately downstream of the turbine blades 68 of the first stage of the turbine 28.

Moreover, as shown in FIG. 2, a plurality of access ports 62 may be defined through the turbine casing and/or frame, with each access port 62 being configured to provide access to the interior of the turbine 28 at a different axial location. Specifically, as indicated above, the access ports 62 may, in several embodiments, be spaced apart axially such that each access port 62 is aligned with or otherwise provides interior access to a different stage of the turbine 28. For instance, as shown in FIG. 2, a first access port 62A may be defined through the turbine casing/frame to provide access to the first stage of the turbine 28 while a second access port 62B may be defined through the turbine casing/frame to provide access to the second stage of the turbine 28.

It should be appreciated that similar access ports 62 may also be provided for any other stages of the turbine 28 and/or for any turbine stages of the second (or low pressure) turbine 32. It should also be appreciated that, in addition to the axially spaced access ports 62 shown in FIG. 2, access ports 62 may be also provided at differing circumferentially spaced locations. For instance, in one embodiment, a plurality of circumferentially spaced access ports may be defined through the turbine casing/frame at each turbine stage to provide interior access to the turbine 28 at multiple circumferential locations around the turbine stage.

At least one bladder can be installed within the engine to form a circumferential seal therein. Referring to FIG. 2, a first bladder 100 is installed and positioned between the plurality of first stage turbine nozzles 66 and the annular array of rotating turbine blades 68. For example, the first bladder 100 may be installed by inserting the first bladder 100, in an uninflated state, through one of the access ports 62. Then, the first bladder 100 can be inflated using an inflating fluid, such as a liquid, foam, a gas.

Figure 3:
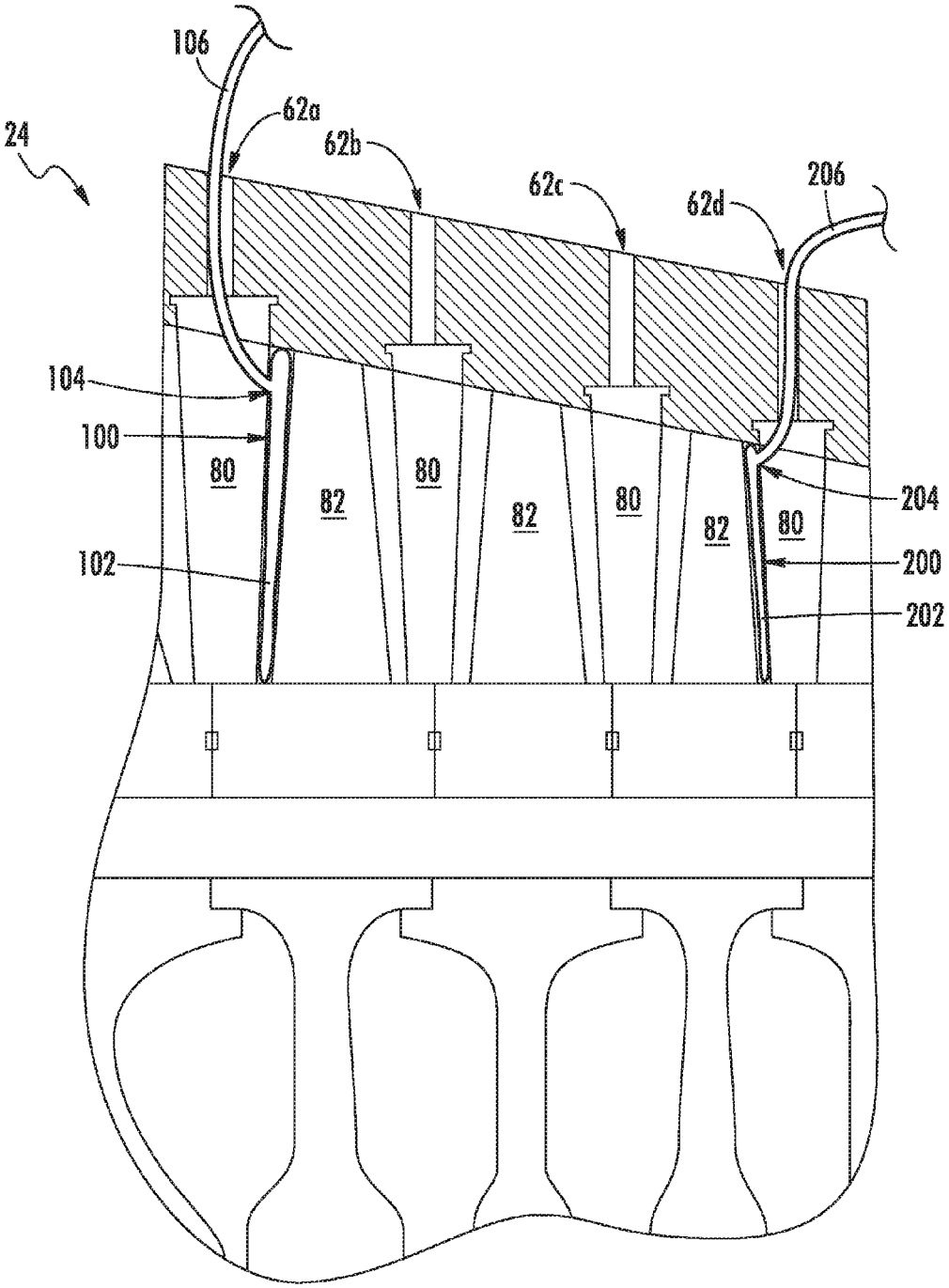
FIG. 3 illustrates a partial, cross-sectional view of one embodiment of a compressor suitable for use within the gas turbine engine shown in FIG. 1, particularly illustrating access ports defined in the engine for providing internal access to the compressor.

Referring now to FIG. 3, a partial, cross-sectional view of the high pressure compressor 24 described above with reference to FIG. 1 is illustrated in accordance with embodiments of the present subject matter. As shown, the compressor 24 may include a plurality of compressor stages, with each stage including both an annular array of fixed compressor vanes 80 (only one of which is shown for each stage) and an annular array of rotatable compressor blades 82 (only one of which is shown for each stage). Each row of compressor vanes 80 is generally configured to direct air flowing through the compressor 24 to the row of compressor blades 82 immediately downstream thereof.

Moreover, the compressor 24 may include a plurality of access ports 62 defined through the compressor casing/frame, with each access port 62 being configured to provide access to the interior of the compressor 24 at a different axial location. Specifically, in several embodiments, the access ports 62 may be spaced apart axially such that each access port 62 is aligned with or otherwise provides interior access to a different stage of the compressor 24. For instance, as shown in FIG. 3, first, second, third and fourth access ports 62*a*, 62*b*, 62*c*, 62*d* are illustrated that provide access to four successive stages, respectively, of the compressor 24.

It should be appreciated that similar access ports 62 may also be provided for any of the other stages of the compressor 24 and/or for any of the stages of the low pressure compressor 22. It should also be appreciated that, in addition to the axially spaced access ports 62 shown in FIG. 3, access ports 62 may be also provided at differing circumferentially spaced locations. For instance, in one embodiment, a plurality of circumferentially spaced access ports may be defined through the compressor casing/frame at each compressor stage to provide interior access to the compressor 24 at multiple circumferential locations around the compressor stage.

Similar to the embodiment shown in FIG. 2, a first bladder 100 is installed and positioned within two compressor stages (i.e., between a first annular array of fixed compressor vanes 80 and a first annular array of rotatable compressor blades 82). A second bladder 200 is installed and positioned within two compressor stages (i.e., between a first annular array of fixed compressor vanes 80 and a first annular array of rotatable compressor blades 82). As such, the first bladder 100 and the second bladder 200 may, after inflating, seal the area therebetween to isolate that area from the other areas of the engine for local work (e.g., cleaning, coating, etc.).

Figure 4:
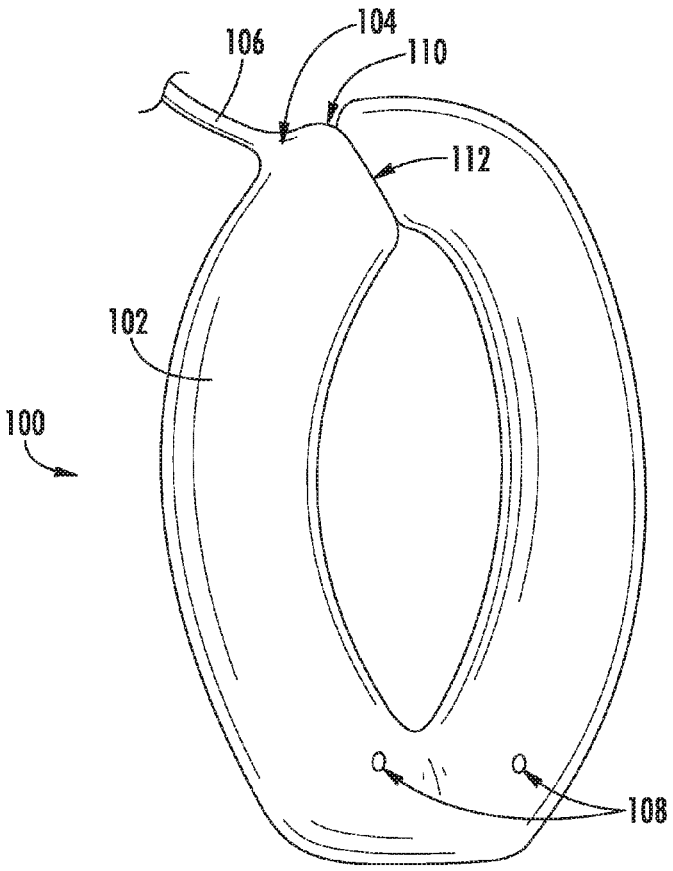
FIG. 4 illustrates a perspective view of an exemplary inflated bladder for use within the gas turbine engine shown in FIG. 1.

In the embodiments of FIGS. 2 and 3, the first bladder 100 and second bladder 200 can be inflated by supplying the fluid through an inlet 104, 204 through a supply tube 106, 206 from a fluid source 107, 207, respectively. In the embodiment of FIG. 4 with respect to the first bladder 100, the supply tube 106 is integral to the bladder body 102 so as to inflate the bladder body 102 between a first end 110 and a second end 112. Upon inflation, the bladder body 102 expands in its respective circumferential direction and in its respective longitudinal direction between the first end 110 and a second end 112. Thus, the inflated bladder body 102 fills the local space within the engine within which it is positioned. For example, the inflated bladder body 102 can extend between adjacent components within the engine (e.g., a row of stator vanes and an annular array of rotating blades, while contacting the arcuate outer band 72 and arcuate inner bands 74 as shown in FIG. 2). Additionally, the expansion in its respective longitudinal direction allows the bladder body 102 to expand circumferentially within the engine such that the first end 110 contacts the second end 112 to form a seal therebetween. In the embodiment shown, the inlet 104 is positioned at the first end 110 of the bladder body 102. In this embodiment, the second end 112 can be inserted as desired within the engine, with the bladder body 102 trailing. For example, the second end 112 can be attached to a fiber optic cable delivery system (not shown) and positioned within the engine as desired. However, in other embodiments, the inlet 104 can be positioned in another position on the bladder body 102.

In one embodiment, the material of the first and second bladders 100, 200 may be a fluid impermeable (e.g., a liquid impermeable material and/or a gas impermeable). In another embodiment, the material of the first and second bladders 100, 200 may be somewhat impermeable to the inflating fluid so as to allow for slow passing of the fluid through the bladders (e.g., at a flow through rate that is slower than the supply rate of the inflating fluid). The first and second bladders 100, 200 can be constructed of a deformable material, such as a plastic material (e.g., a plastic film, a plastic fibrous web, etc.), a rubber material, a paper material (e.g., a saturated paper material), or another material.

In one embodiment, at least one exit port 108 may be included in the bladder body 102 as shown in FIG. 4. Such an exit port 108 may be configured to supply the inflating fluid into the engine, particularly as in the embodiments shown in FIGS. 2 and 3 so as to supply the inflating fluid into the isolated area. As stated, the first bladder 100 can be inflated using an inflating fluid, such as a liquid, foam, a gas. For example, in one embodiment, the inflating fluid can include water, an inert gas, a cleaning fluid, etc. In one embodiment, the inflating fluid can include particular material, such as organic material (e.g., wood chips, wood pellets, nut shells, or a mixture thereof). As such, the engine (e.g., the isolated compartment) may be exposed to a desired material, such as a cleaning agent, an abrasive agent, etc.

The inflating fluid can be supplied through the inlet 104 at a supply rate of fluid flow that is greater than (i.e., faster than) the fluid outflow rate through the exit ports 108. As such, the bladder body 102 may remain in its fully inflated state so as to keep the circumferential seal within the engine while still supplying the inflated fluid into the engine through the exit port 108.

Figure 5:
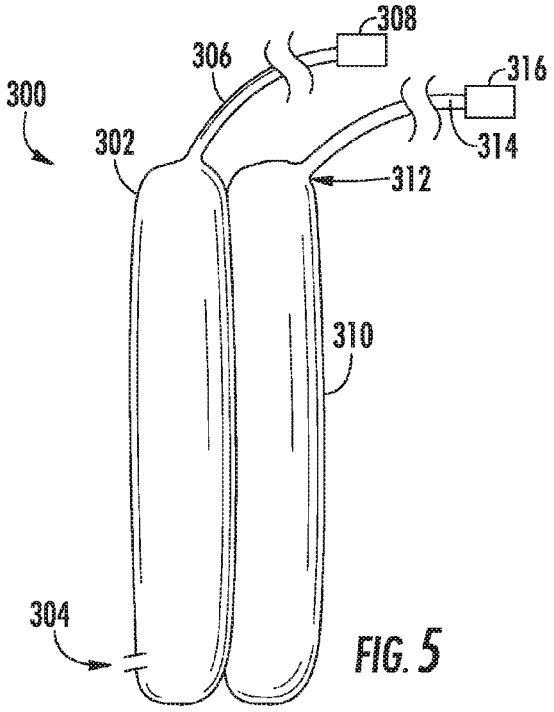
FIG. 5 illustrates a side view of another exemplary inflated bladder for use within the gas turbine engine shown in FIG. 1.

In one embodiment, the second bladder 200 may be configured to recover the fluid from within the isolated compartment. Referring to FIG. 5, an embodiment of a recovery bladder 300 is generally shown, which includes a first recovery body 302 having a recovery port 304 exposed to the isolated compartment. The first recovery body 302 can be in fluid communication with a pump 308, through recovery tube 306, to remove the inflating fluid from the isolated compartment supplied from the first bladder 100. The recovery bladder 300 can also include an adjacent to and/or attached to a third bladder body 310 inflated through the inlet 312 from the supply tube 314 and the supply tank 316. For example, the recovery bladder 300 can be an integrated double bladder that defines separate internal compartments (i.e., the recovery body 302 and the third bladder body 310). Through this configuration, the third bladder body 310 may provide structural stability during fluid recovery through the recovery body 302. However, in other embodiments, the recovery bladder 300 may include structural support members (not shown), internal and/or external to the bladder body 302.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for forming an in situ temporary barrier within a gas turbine engine, the method comprising:

installing a first bladder within the gas turbine engine, wherein the first bladder defines a first bladder body;

inflating the first bladder with an inflating fluid such that the first bladder body forms a circumferential seal within the gas turbine engine, the circumferential seal occurring in a gas turbine gas path at a first axial location and occupying an entire gas turbine gas path area at said first axial location; and installing a second bladder positioned circumferentially within the gas turbine engine; wherein the second bladder is axially spaced apart from the first bladder.

2. The method as in claim 1, wherein the first bladder body is positioned between a row of stator vanes and an annular array of rotating blades to form the circumferential seal therebetween, the first bladder body forming an isolated compartment of the gas turbine gas path with the second bladder, wherein the circumferential seal prevents at least one of cleaning and repair materials from traveling to an upstream or downstream location within the gas turbine gas path from said isolated compartment.

3. The method as in claim 2, further comprising;

performing at least one repair operation within the gas turbine gas path, wherein the first bladder comprises a plastic material.

4. The method as in claim 3, wherein the plastic material is a film.

5. The method as in claim 3, wherein the plastic material is a fibrous web.

6. The method as in claim 2, wherein the first bladder comprises a rubber material, and wherein the first bladder comprises an arcuate inner band and an arcuate outer band.

7. The method as in claim 6, further comprising:

inflating the second bladder with an inflating fluid, wherein the second bladder defines a plurality of ports therein.

8. The method as in claim 1, wherein the first bladder comprises a paper material.

9. The method as in claim 1, wherein the inflating fluid comprises a liquid, a foam, or a gas.

10. The method as in claim 1, wherein the inflating fluid comprises cleaning fluid.

11. The method as in claim 1, wherein the inflating fluid comprises an organic material.

12. The method as in claim 11, wherein the organic material comprises wood chips, wood pellets, nut shells, or a mixture thereof.

13. The method as in claim 1, wherein the first bladder body defines exit ports configured to supply the inflating fluid into the gas turbine engine.

14. The method as in claim 13, wherein the inflating fluid has a fluid flow rate into the first bladder body that is greater than a fluid outflow rate through the exit ports.

15. The method as in claim 7, wherein the second bladder is connected to a collection pump drawing a vacuum through the second bladder and the plurality of ports.

16. The method as in claim 15, wherein any fluid exiting the first bladder body is recovered through the ports of the second bladder.

17. The method as in claim 16, wherein the second bladder is adjacent to a third bladder for structural stability during fluid recovery.

18. The method as in claim 17, wherein the second bladder is attached to the third bladder to form an integrated double bladder that defines separate internal compartments.

19. A method for forming an in situ temporary barrier within a gas turbine engine, the method comprising:

inserting an uninflated first bladder through a port into a gas turbine gas path;

placing the uninflated first bladder at a first axial location within the gas turbine gas path;

inflating the first bladder to seal off an entire gas turbine gas path annulus at said first axial location;

performing one or more operations within the gas turbine gas path adjacent to the first axial location;

flushing the gas turbine gas path adjacent to the first axial location;

deflating the first bladder; and removing the deflated first bladder from the gas turbine gas path.

20. The method of claim 19, further comprising;

after the first bladder is inflated, inserting a second bladder into the gas turbine gas path at a second axial location, the second axial location being downstream from the first axial location; and inflating the second bladder, wherein the one or more operations comprises one or more cleaning operations.

* * * * *